US012521597B2

(12) United States Patent
Westbrook et al.

(10) Patent No.: US 12,521,597 B2
(45) Date of Patent: Jan. 13, 2026

(54) MULTI-PURPOSE FUNCTIONAL RUCK WEIGHT

(71) Applicant: Gloom Foundry, LLC, Austin, TX (US)

(72) Inventors: Graham Westbrook, Austin, TX (US); Kyle McClintock, Pflugerville, TX (US); Nathan Tacha, Austin, TX (US); Matt Lagusis, Dripping Springs, TX (US); Brian Shimansky, Austin, TX (US)

(73) Assignee: Gloom Foundry, LLC, Austin, TX (US)

( * ) Notice: Subject to any disclaimer, the term of this patent is extended or adjusted under 35 U.S.C. 154(b) by 68 days.

(21) Appl. No.: 18/150,681

(22) Filed: Jan. 5, 2023

(65) Prior Publication Data

US 2023/0211200 A1 Jul. 6, 2023

Related U.S. Application Data

(60) Provisional application No. 63/266,509, filed on Jan. 6, 2022.

(51) Int. Cl.

| | |
|---|---|
| ***A63B 21/072*** | (2006.01) |
| ***A63B 21/00*** | (2006.01) |
| *A63B 71/00* | (2006.01) |

(52) U.S. Cl.

CPC ..... *A63B 21/072* (2013.01); *A63B 21/4035* (2015.10); *A63B 2071/0063* (2013.01); *A63B 2225/76* (2020.08)

(58) Field of Classification Search

CPC ..... A63B 21/072; A63B 21/4035; A63B 2071/0063; A63B 2225/76; A63B 2071/0694; A63B 21/06–0607

See application file for complete search history.

(56) References Cited

U.S. PATENT DOCUMENTS

D275,302 S * 8/1984 Rotella ..... D21/692
4,515,364 A * 5/1985 Rotella ..... A63B 21/045 482/122

(Continued)

FOREIGN PATENT DOCUMENTS

CN 216366472 U 4/2022

OTHER PUBLICATIONS

Body Institute, Body Institute Dumbbell Hand Weights Ring Shaped Dumbbell Home Fitness Exercise Dumbbells for Women Men Gym Workout Office Strength Training Kettlebell, Amazon.com, accessed Oct. 25, 2022, https://a.co/d/5wXnwuD.

(Continued)

*Primary Examiner* — Nyca T Nguyen

(74) *Attorney, Agent, or Firm* — Thompson Patent Law Offices PC

(57) ABSTRACT

Apparatus and associated methods relate to a multi-purpose functional ruck weight (FRW). The FRW includes a packing mode, a two-handed swinging mode, and a dumbbell mode. The FRW is a weight reflectively mirrored about a bisecting longitudinal axis. The weight includes a top and a bottom surface. The FRW includes a swing handle defined by a first aperture extending through the top and bottom surfaces. The weight may be carried in a rucksack against the user's body in a packing mode. The first aperture may be configured such that the first and second hand of the user, in a two-handed swinging mode, are spatially distributed and oriented along intersecting axes. The grip handle may be configured, in a dumbbell mode, such that the user's first hand is inserted through the second and third aperture to grip the grip handle at the center of the FRW.

18 Claims, 13 Drawing Sheets

(56) References Cited

U.S. PATENT DOCUMENTS 4,673,179 A * 6/1987 Pengler ..... A63B 21/072 482/148
5,692,996 A * 12/1997 Widerman ..... A63B 21/072 482/106
5,716,305 A * 2/1998 Selsam ..... A63B 21/00047 482/52
D450,361 S * 11/2001 Harms ..... D21/680
6,312,364 B1 * 11/2001 Selsam ..... A63B 21/06 482/52
6,436,015 B1 * 8/2002 Frasco ..... A63B 21/072 482/106
D566,207 S * 4/2008 Cao ..... D21/681
7,972,250 B2 * 7/2011 Viselman ..... A63B 21/072 482/141
8,585,563 B2 * 11/2013 Wilson ..... A63B 21/4035 482/141
8,702,570 B1 * 4/2014 DelPriore ..... A63B 23/0355 482/52
8,840,531 B2 * 9/2014 Viselman ..... A63B 21/00061 482/109
8,998,778 B2 * 4/2015 Potts ..... A63B 21/0724 482/106
D741,961 S * 10/2015 Maribona ..... D21/684
D742,462 S * 11/2015 Cotto-Colon ..... D21/662
9,616,269 B1 * 4/2017 Burosh ..... A63B 21/0004
9,925,408 B1 * 3/2018 Murdock ..... A63B 21/4043
D843,512 S * 3/2019 Petek ..... D21/682
10,449,404 B2 * 10/2019 Wood ..... A63B 23/0205
D895,740 S * 9/2020 Lovegrove ..... D21/680
11,045,684 B2 * 6/2021 Daly ..... A63B 21/072
11,097,147 B2 * 8/2021 Jones ..... A63B 21/0607
D930,766 S * 9/2021 Meaney ..... D21/680
D949,261 S * 4/2022 Connors, Jr. ..... D24/188
D968,536 S * 11/2022 Rogov ..... D21/682
D1,005,420 S * 11/2023 Petek ..... D21/680
11,865,423 B1 * 1/2024 Holliday ..... A41D 13/0015
2004/0166997 A1 * 8/2004 Vigiano ..... A63B 21/072 482/106
2006/0003874 A1 * 1/2006 Hamilton ..... A63B 21/06 482/93
2006/0073948 A1 * 4/2006 Lincir ..... A63B 21/06 482/106
2006/0079380 A1 * 4/2006 Wells ..... A63B 21/4019 482/49
2006/0229173 A1 * 10/2006 Foley ..... A63B 21/4007 482/105
2008/0108483 A1 5/2008 Fife
2010/0069206 A1 * 3/2010 Viselman ..... A63B 21/0602 482/106
2011/0028285 A1 2/2011 Towley, III et al.
2012/0172182 A1 7/2012 Leier et al.
2012/0283073 A1 * 11/2012 Zabel ..... A63B 21/0603 482/93
2014/0024504 A1 * 1/2014 Potts ..... A63B 21/4035 482/106
2014/0135186 A1 5/2014 Reynolds et al.
2016/0082307 A1 * 3/2016 Widerman ..... A63B 21/4043 482/139
2016/0129327 A1 * 5/2016 Pinto ..... A63B 71/14 473/438
2016/0144220 A1 * 5/2016 Wood ..... A63B 21/0601 482/93
2016/0236029 A1 * 8/2016 Kaszer ..... A63B 21/072
2017/0072251 A1 3/2017 Fuzell-Casey et al.
2018/0085619 A1 * 3/2018 Chen ..... A63B 23/12
2018/0117396 A1 * 5/2018 Engelfried, Jr. ... A63B 23/0405
2018/0169456 A1 * 6/2018 Rachele ..... A61B 5/6895
2022/0105381 A1 * 4/2022 Anderson ..... A63B 21/4035
2022/0105383 A1 * 4/2022 Mugulusi ..... A63B 21/0601
2022/0233906 A1 * 7/2022 Azenha ..... A63B 21/0604
2023/0109151 A1 * 4/2023 Matsushima ..... A63B 69/3667 473/207
2023/0271048 A1 * 8/2023 Dao ..... A63B 21/065 482/92

OTHER PUBLICATIONS

ECLEAR, ELECOM ECLEAR square hand grip plate 2.3kg, accessed Oct. 25, 2022, https://en.pinkoi.com/product/XKRMRARX.
Feite, 2 in 1 Weights Dumbbells Kettlebell, 11lb 16lb 22lb 28lb 33lb Triangle Neoprene Coated Dumbbell Weights for Men Women Hand Weights Exercise & Fitness at Home Gym, Single, Amazon.com, accessed Oct. 25, 2022, https://www.amazon.com/Dumbbells-Kettlebells-Triangle-Neoprene-Kettlebell/dp/B08RBKD36H/ref=asc_df_B08RBKD36H/?tag=hyprod-20&linkCode=df0&hvadid=533236522019&hvpos=&hvnetw=g&hvrand=11876609821904885217&hvpone=&hvptwo=&hvqmt=&hvdev=c&hvdvcmdl=&hvlocint=&hvlocphy=9028310&hvtargid=pla-1421430000204&th=1.
Fringe Sport, Bonehead Ruck Weight Plate, accessed Oct. 25, 2022, https://www.fringesport.com/products/fringes-sport-ruck-weight-plate?variant=39336178319407.
Gear Elevation, Kettlebell Dumbbell Grip, accessed Oct. 25, 2022, https://gearelevation.com/products/kettlebell-dumbbell-grip.
Goruck, Ruck Plates (Standard), accessed Oct. 25, 2022, https://www.goruck.com/products/ruck-plates.
Lesmills, Bodypump Bundle, accessed Oct. 25, 2022, https://shop.lesmills.com/us/bodypump-bundle-6m-free-US.
Mutt, Mutt Bars | Weighted Exercise Bars, Rogue USA, accessed Oct. 25, 2022, https://www.roguefitness.com/mutt-bars.
Sportneer, Multi-usage Dumbbells Set of 2 (5.5 lbs Each): Sportneer Innovative Design Neoprene Dumbbell Hand Weights—Combination of Dumbbell, Kettlebell and Weight Plate, 3-in-1 Weights Dumbbells for Exercise, Workout, Body Building, Strength Training, Amazon.com, accessed Oct. 25, 2022, https://a.co/d/bPFjG8V.
Strietelmeier, J., These kettlebells can store flat in a drawer!, The Gadgeteer, accessed Oct. 25, 2022, https://the-gadgeteer.com/2022/06/03/these-kettlebells-can-store-flat-in-a-drawer/.
Titan Fitness, 20lb Ruck Weight Pates, accessed Oct. 25, 2022, https://www.titan.fitness/strength/weight-plates/specialty-plates/20-lb-ruck-weight/430158.html.
Yes4all, Yes4All 3-in-1 Premium Cast Iron Ruck Weight Plate—Multi Weights Available: 10/15/20/25/30/35/45LB for Rucking, Swings, Squat, Strength Training, Fitness Workout and Home Exercises, Amazon.com, accessed Oct. 25, 2022, https://www.amazon.com/dp/B09TDBR79L/ref=twister_BOBHH927NF?th=1.

* cited by examiner

MULTI-PURPOSE FUNCTIONAL RUCK WEIGHT

CROSS-REFERENCE TO RELATED APPLICATIONS

This application is a non-provisional application and claims the benefit of U.S. Application Ser. No. 63/266,509, titled "Multi-Purpose Functional Ruck Weight," filed by Graham Westbrook, et al., on Jan. 6, 2022.

TECHNICAL FIELD

Various embodiments generally relate to strength training equipment.

BACKGROUND

Weight training is a method for developing strength, increasing the size of skeletal muscles, and maintaining strength. Weight training allows a user to use the force of gravity from weights to oppose the force generated by the user's muscle contraction. Weight training uses various equipment and movement types to target specific muscle groups.

Free weights include dumbbells, barbells, medicine balls, sandbells, and kettlebells. Free weights do not constrain users to fixed movements. Free weight requires more effort from a user's stabilizer muscles. Some free weight exercises can be performed sitting, lying on the ground, and/or using other equipment such as an exercise ball.

Rucking is the action of walking and/or jogging with a weight on your back. Walking with a weighted rucksack and/or backpack is a low-impact exercise. Carrying weight is a typical part of a person's daily routine. Rucking is used commonly in military training, physical conditioning in police forces, and by fitness enthusiasts. For example, in military training, a soldier may carry sandbags while jogging. For example, a soldier may jog in boots and military gear while carrying a weighted rucksack.

SUMMARY

Apparatus and associated methods relate to a multi-purpose functional ruck weight (FRW). The FRW includes a packing mode, a two-handed swinging mode, and a dumbbell mode. The FRW is a weight reflectively mirrored about a bisecting longitudinal axis. The weight includes a top and a bottom surface. The FRW includes a swing handle defined by a first aperture extending through the top and bottom surfaces. The weight may be carried in a rucksack against the user's body in a packing mode. The first aperture may be configured such that the first and second hand of the user, in a two-handed swinging mode, are spatially distributed and oriented along intersecting axes. The grip handle may be configured, in a dumbbell mode, such that the user's first hand is inserted through the second and third aperture to grip the grip handle at the center of the FRW.

Various embodiments may achieve one or more advantages. For example, some embodiments may include a grip handle distal to the swing handle, the grip handle defined by a second aperture and a third aperture extending through the top and bottom surfaces. The FRW includes a major and a minor dimension separated by a thickness to define a spacial envelope. The FRW may, for example, include finger divots. The swing handles of the FRW may, for example, include countours. The grip handle of the FRW may, for example, include contours. The grip handles of the FRW may, for example, include textured grips. The grip handles of the FRW may, for example, include a coated grip. The FRW spacial envelope may, for example, be coated by an external damper such that the external damper absorbs kinetic energy during an impact. The swing handle of the FRW may, for example, include contours to increase the surface area of engagement with the user's hands. The grip handle of the FRW may, for example, include a textured grip to increase the coefficient of friction between the user's hands and the grip handle.

The details of various embodiments are set forth in the accompanying drawings and the description below. Other features and advantages will be apparent from the description, drawings, and claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, a use-case system is introduced with reference to FIGS. 1A-ID. With reference to FIGS. 2-10B, the FRW various views and exemplary dimensions are illustrated.

Figure 1A:
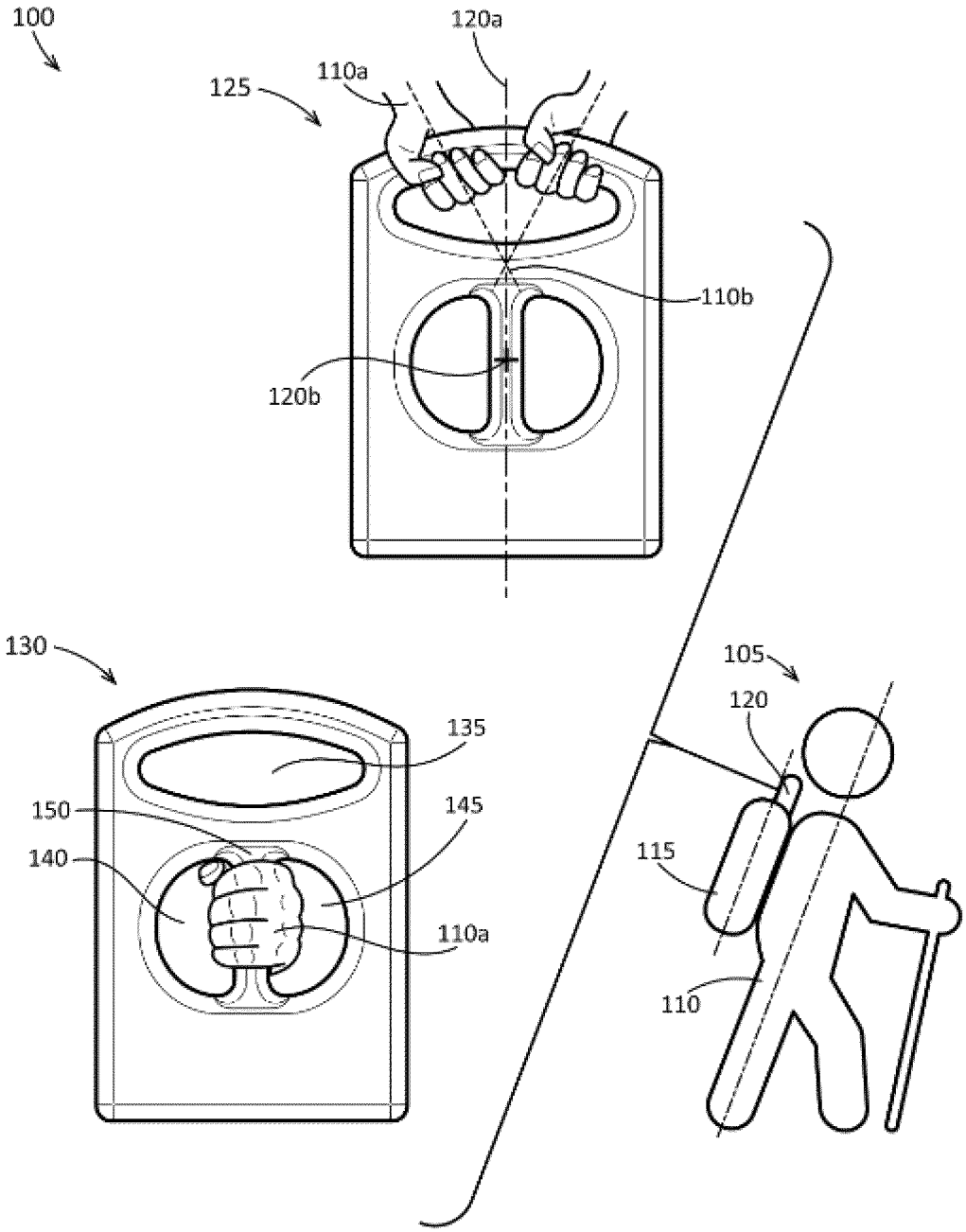
FIG. 1A depicts an exemplary multi-purpose functional ruck weight (FRW) employed in illustrative use-case scenarios, including a ruck mode; a dumbbell mode; and a two-handed overhand mode.

FIG. 1A depicts an exemplary multi-purpose functional ruck weight (FRW) employed in illustrative use-case scenarios 100, including a ruck mode; a dumbbell mode; and a two-handed overhand mode. The illustrative use-case scenarios 100 includes a backpacking use-case scenario 105.

The backpacking use-case scenario 105 includes a user 110. The user 110 is wearing a rucksack 115. The rucksack may, for example, include a backpack. In some implementations, the weight may be transported in luggage for travel. The rucksack 115 contains an exemplary FRW 120. In the backpacking use-case scenario 105, the exemplary FRW 120 is aligned with the back of the user 110.

The use-case scenario 100 includes a swing mode exemplary scenario 125. The swing mode exemplary scenario 125 includes a user's hands 110*a*. The swing mode exemplary scenario 125 includes a longitudinal axis 120*a* bisecting the exemplary FRW 120. The swing mode exemplary scenario 125 includes an axis orthogonal to the longitudinal axis (not shown). The hands 110*a* include a user's hands axes 110*b* that bisects each hand, configured such that, the hands' axes intersect when grasping the swing handle. The exemplary FRW 120 includes a center of mass of the weight 120*b*.

The illustrative use-case scenarios 100 includes a grip handle use-case scenario 130. The grip handle use-case scenario 130 includes a first aperture 135 near the proximal end of the weight. The grip handle use-case scenario 130 includes a second aperture 140. The grip handle use-case scenario 130 includes a third aperture 145. The exemplary FRW 120 includes a handle 150. The second aperture 140 and third aperture 145 allow a user's hand 110*a* to grasp the handle 150.

Figure 1B:
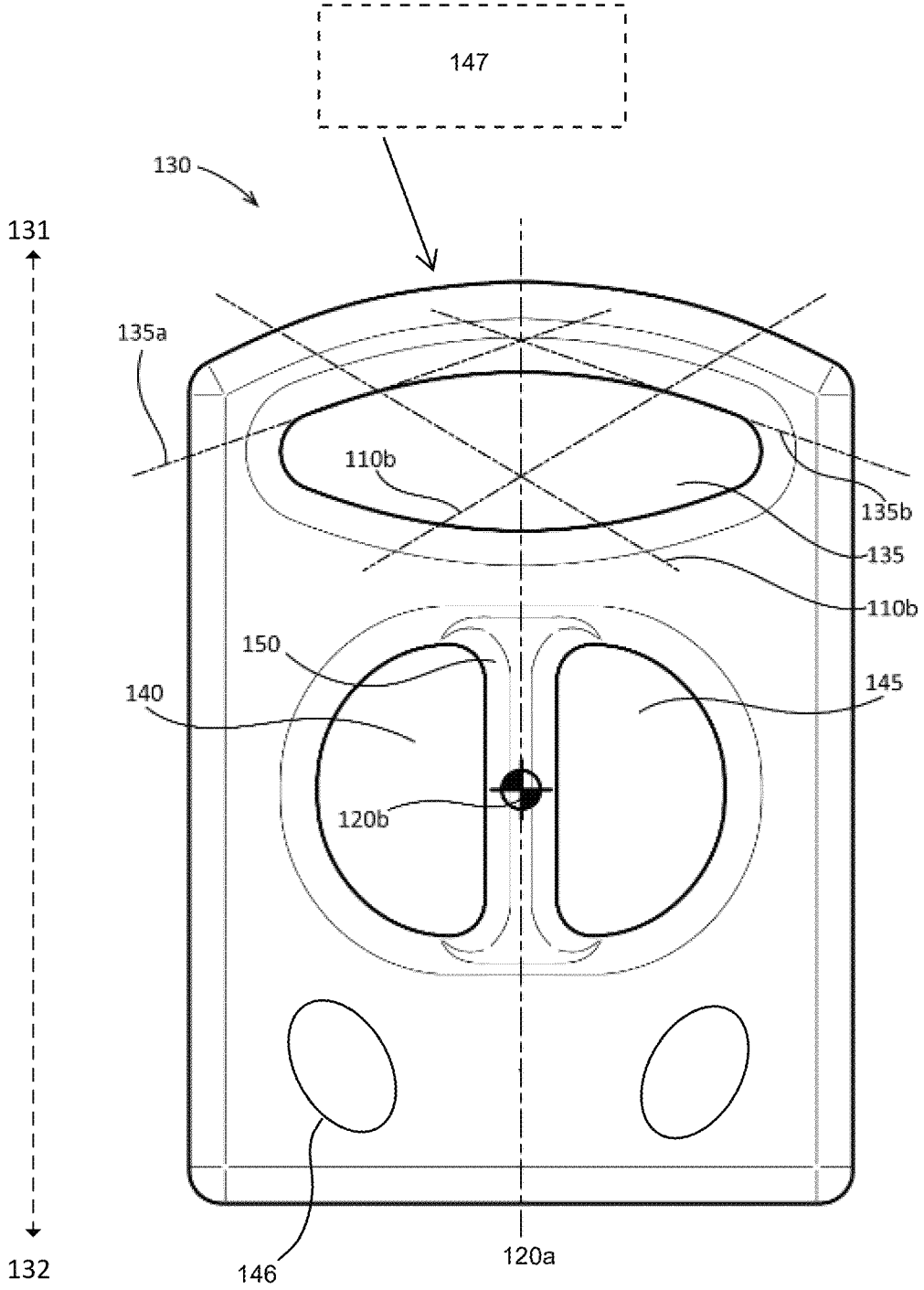
FIG. 1B is a block diagram depicting an exemplary diagram of an exemplary FRW and shows the interaction of a user's hands with the tangent lines of the first aperture.

FIG. 1B is a block diagram depicting an exemplary diagram of an exemplary FRW and shows the interaction of a user's hands with the tangent lines of the first aperture. The grip handle use-case scenario 130 includes a proximal end 131 of the FRW. Te grip handle use-case scenario 130 includes a distal end 132 of the FRW. The proximal and distal ends of the weight may be referred to this orientation in all other modes unless otherwise specified. The grip handle use-case scenario 130 in FIG. 1B includes a first tangent line 135*a* of the first aperture 135. The grip handle use-case scenario 130 in FIG. 1B includes a second tangent line 135*b* of the first aperture 135. The first tangent line 135*a* of the first aperture and the second tangent of the first aperture intersect. In a two-handed mode, the user's hands axes 110*b* intersect both the first tangent line 135*a* and the second tangent line 135*b*.

The depicted FRW 120 includes finger divots 146. The depicted FRW 120 includes a grip attachment 147.

Figure 1C:
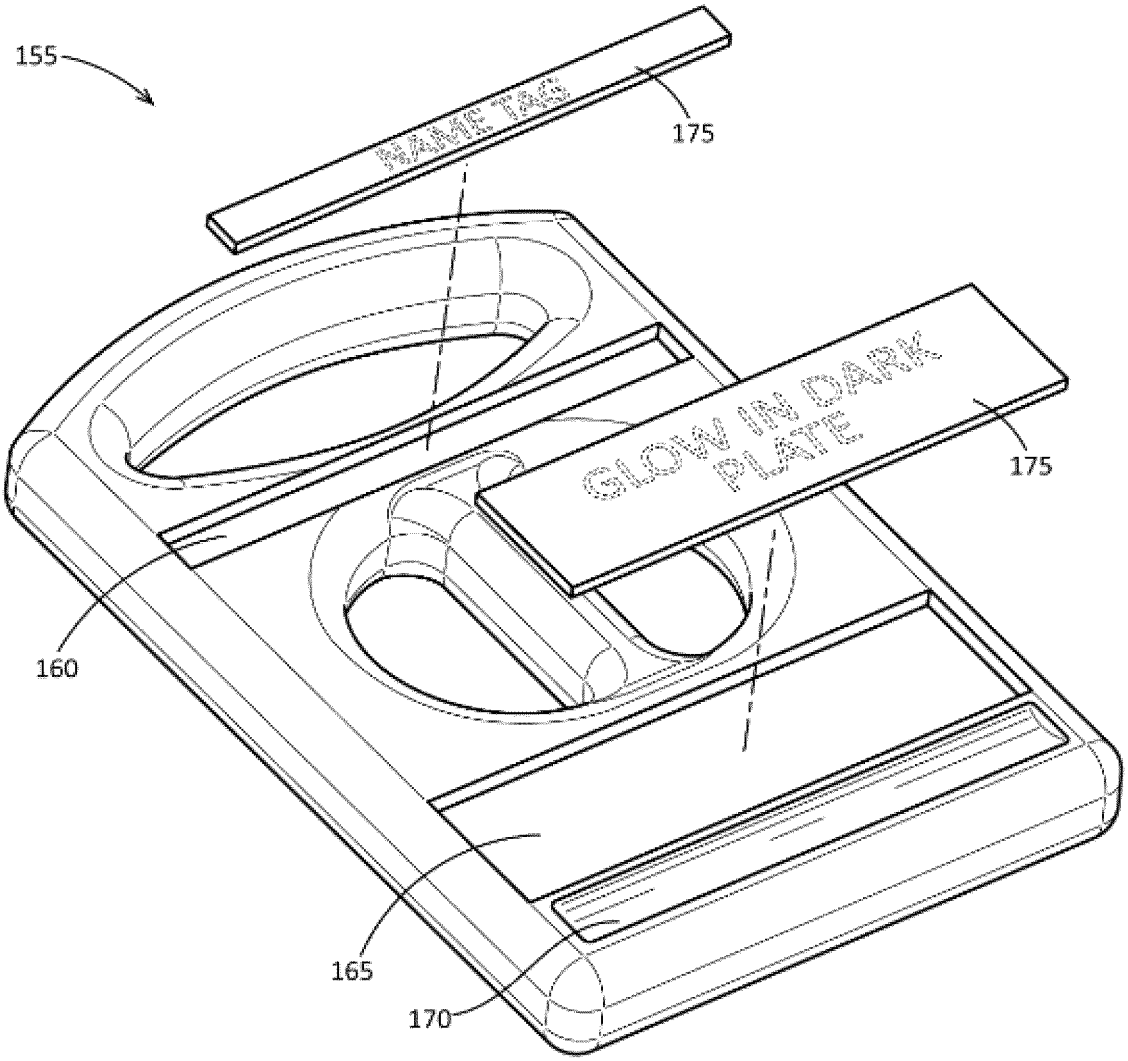
FIG. 1C depicts an exemplary FRW with recesses, finger grips, and attachments.

FIG. 1C depicts an exemplary FRW 155 with recesses, finger grips, and attachments. The exemplary FRW 155 includes an exemplary recess 160. By way of example and not limitation, the exemplary recess may be ⅛" deep. The exemplary recess may be 1/16" deep. The exemplary recess may be ¼" deep. The exemplary FRW 155 includes a finger grip 170. The finger grip may, for example, allow a user to grip the distal end of the FRW. The exemplary FRW 155 includes attachments. The attachments may, by way of example, but not in limitation, include nameplates. The attachments, by way of example, but not in limitation, include messages. The attachment, by way of example, but not in limitation, may be phosphorescent. The attachments may, for example, enclose the grip handle. The attachments may, for example, enclose the grip handle to improve the grip, reduce blister formation on a user's hand, and prevent the tearing of the skin when using the weight. The attachment may, for example, include a paracord wrapped along the center grip handle. The attachments may, for example, include a name tag. The attachments may, for example, include a glow-in-the-dark plate with a message depicted. The attachments may, for example, include an American flag. The attachments may, for example, include a Texan flag.

Figure 1D:
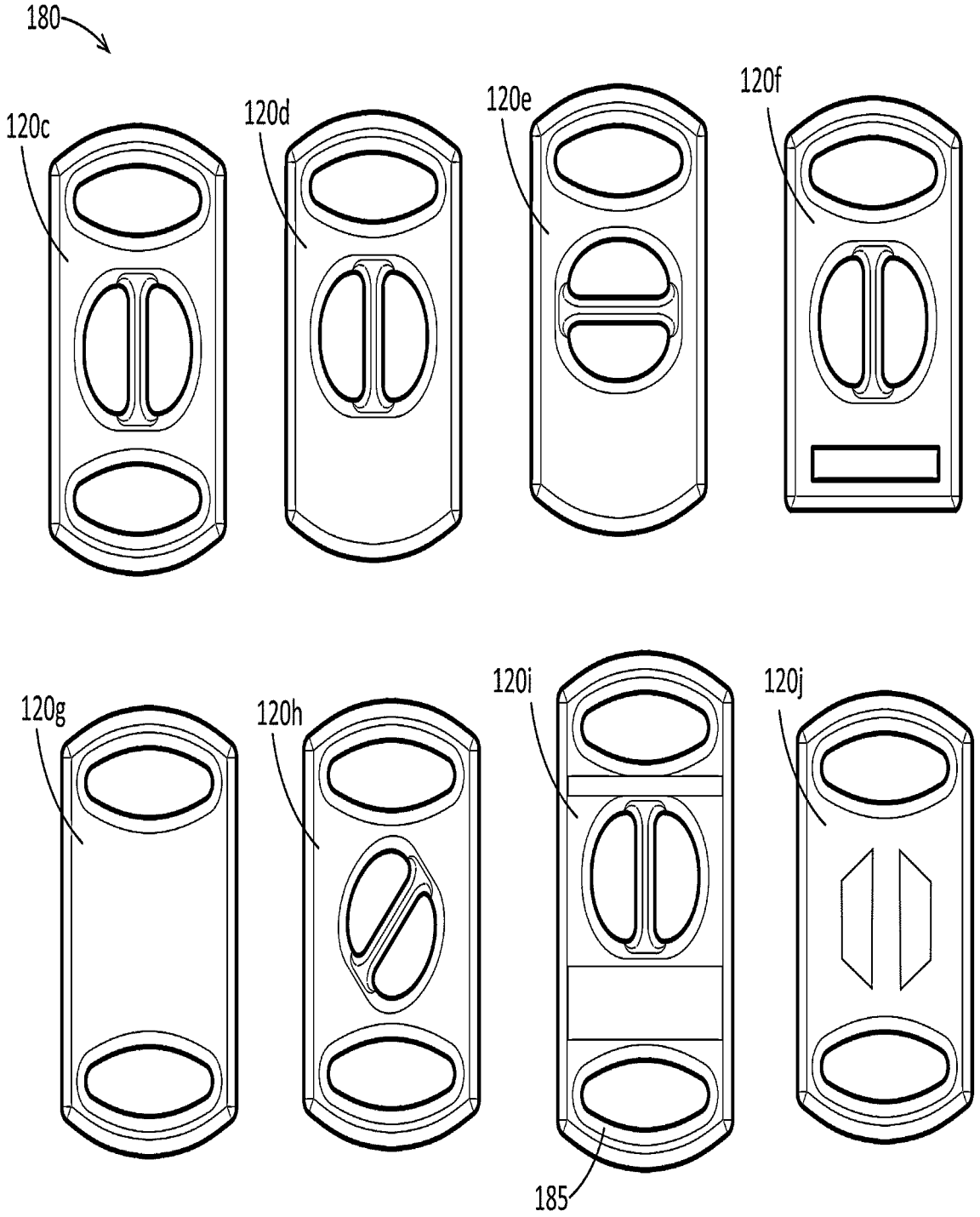
FIG. 1D depicts an array of several embodiments of exemplary FRWs.

FIG. 1D depicts an array 180 of several embodiments of exemplary FRWs.

The array 180 includes an exemplary FRW 120*c* with a fourth aperture. The fourth aperture reflectively mirrors the first aperture along an axis that bisects the center of the plate that is orthogonal to the longitudinal axis. The exemplary FRW 120*c* includes a first swing handle, a grip hand, and a second swing handle. A person may, for example, use the exemplary FRW in a rucking mode. A user may, for example, use the exemplary FRW in dumbell mode, such that the user would grip the grip handle to perform extension exercises. A user may, for example, grip a first swing handle near the proximal end of the weight, in a two-handed mode such that, the user may perform swinging exercises while griping the first swing handle by putting their fingers through the first aperture. A user may, for example, grip a second swing handle near the distal end of the weight, in a two-handed mode such that, the user may perform swinging exercises while griping the second swing handle by putting their fingers through the first aperture.

The array 180 includes an exemplary FRW 120*d*. The exemplary FRW 120*d* includes a curved end near the distal end of the weight. The bottom curvature may, for example, be desirable while rucking, because the curvature may prevent shifting while the ruck rests in the weight.

The array 180 includes an exemplary FRW 120*c*. The exemplary FRW 120*e* includes a grip handle that is parallel to an axis orthogonal to the longitudinal axis bisecting the weight. A user may, for example, desire to switch the way the user grip's the grip handle for different exercises and muscle extensions.

The array 180 includes an exemplary FRW 120*f*. The exemplary FRW 120*f* includes a fourth aperture. The fourth aperture is a different size and shape than the first aperture. The fourth aperture may, for example, include a rectangular shape, an oval shape, and/or a circular shape. The first aperture may for example also have various shapes that may, for example, include a rectangular shape, an oval shape, and/or a circular shape.

The array 180 includes an exemplary FRW 120*g*. The exemplary FRW 120*g* does not include a grip handle. The exemplary FRW includes a first swing handle. The exemplary FRW includes a second swing handle. In some implementations, the second handle may include a rectangular shape, an oval shape, and/or a circular shape.

The array 180 includes an exemplary FRW 120*h*. The exemplary FRW 120*h* includes an angled grip handle relative to the longitudinal axis. The angled grip handle may, for example, allow a user to perform different extensions and exercises. The angled grip handle may, for example, allow a user to perform the same extension and exercises but target different muscles due to the different hand positioning. The FRW 120*h* includes a fourth aperture, which may, for example, include a second swing handle.

The array 180 includes an exemplary FRW 120*i*. The exemplary FRW 120*i* includes a first rectangular recess near the proximal end of the weight. The first rectangular recess may, for example, be used for a name tag. The exemplary FRW 120*i* includes a second rectangular recess. The second rectangular recess may, for example, include an attachment slot for a message.

The array 180 includes an exemplary FRW 120*j*. The exemplary FRW 120*j* includes a half-hexagonal second and half-hexagonal third aperture. The second and third aperture may, for example, be multisided.

The FRW is, as depicted, a multi-purpose fitness system designed to comfortably fit in a backpack and/or rucksack (e.g., for rucking). The FRW may allow easy access to be removed and used as a customizable apparatus for working out and facilitating weight exercises traditionally. The FRW may, in some examples, provide multiple exercises available to a user who, for example, conducts fitness outdoors. In some implementations, the FRW may include glow-in-the-dark features that make it visible when doing late-night, overnight, and/or early morning workout activities outside.

In some examples, rucking- or hiking with weight-sometimes requires a backpack. For example, the backpack may be a specialized rucksack or a vest in order to intentionally increase the weight of a practitioner. For example, the weight may allow the practitioner to build muscle, lose fat, and/or increase stamina. For example, rucking may be easier on the knees than running but adds a level of difficulty to walking.

For example, the FRW may, in some implementations, be substantially 9"×1.375"×15" in size. For example, the FRW may include an edge handle and/or a center handle. The edge handle may, in some implementations, be located at a top side of the FRW. In some examples, an edge handle may be a Kettlebell handle. In some examples, an edge handle may include an altered chamfered edge. For example, an edge may have a radius that allows a lay-flat feel for the wrist doing overhead exercises (e.g. clean/jerk) without impeding motion. The rounded edge may, for example, also be configured to facilitate one- and/or two-handed swinging motions.

The center handle may, for example, be a dumbbell-like handle. In some implementations, the center handle may have enough room in a cavity for bare hands and/or hands with gloves to conduct curling movements, overhead and/or tri-cep movements, and/or neutral grip movements. For example, a practitioner may perform pushups off of a raised feature using the center handle. For example, the center handle may also be configured to allow the FRW to be held in its center of gravity. In some examples, holding the FRW substantially at its center of gravity may get the most out of its weight for movement. In some embodiments, holding the FRW at/near its center may be used to contribute to a shield-like aesthetic that augments the design aesthetic.

In some implementations, the FRW may include a finger grip: For example, the FRW may include a finger grip on one side and ambidextrous thumb recesses on the other side. In some examples, the finger grip may allow a practitioner to hold the FRW ergonomically while overhead and/or underneath without having to clumsily grab the side of the part without having any purchase. This may, for example, advantageously increase the safety of the FRW by substantially reducing the likelihood of dropping and/or may advantageously support functionality.

In some implementations, the FRW may include thumb recesses on opposite sides of the FRW. For example, the thumb recesses may naturally move the thumbs into a grip-position with the hand curled in a C-like position and fingers holding onto the other side. For example, the thumb recesses may improve safety, ergonomics, and/or functionality.

In some implementations, the FRW may include customizability aesthetic features. For example, the FRW may allow a practitioner to customize the part by adding patches and/or other removably coupled (e.g., hook-and-loop enabled) art to be attached/detached from the plate. For example, the FRW may include a 1"×⅛" recess on front of part at the top side. For example, the 1" recess at front-top may be used as a "name tape" which can display a first name, last name, and/or nickname. For example, the FRW may include a 2"×⅛" recess on front of part at the bottom side. For example, the 2" recess at front-bottom of the part may be configured as a 2"×3" decoration to include, for example, flags, morale displays, and/or other atypically-sized patches to be affixed to the part.

In some implementations, the FRW may include a glow technology. For example, the FRW may include glow-resin embedded in at least some portion of the FRW. For example, glow-resin may be embedded as lettering and/or applied as coating for glow-in-the-dark capability. Such embodiments may, for example, advantageously provide visibility during late-night, overnight and/or early morning workouts. For example, a glow resin marine epoxy mix may be poured into certain crevices and/or hardens to become part of the FRW. For example, the FRW may be 'charged' with daylight (e.g., natural light), and/or artificial light (e.g., flashlights) to luminesce (e.g., for hours) and so be (more) visible to the naked eye.

In some implementations, the FRW may be weatherproofing. For example, the part may include an exterior coating that makes it waterproof and/or weatherproof to substantially reduce a likelihood of rust. For example, the weatherproofed FRW may be grasped by bare hands and/or with gloves in the rain with slip resistance (e.g., weatherproofing may include a polymeric component). In some examples, the weatherproofed FRW may protect it from the (outdoor) elements (e.g., sun, moisture, oxygen). Weatherproofing may, for example, advantageously provide a safety element (e.g., preventing slipping during exercising and so preventing injury to self and/or bystanders).

The exemplary FRW may, for example, be used in a single-arm Paincake swing in a rested position. The exemplary FRW may, for example, be used in a single-arm Paincake swing in a raised position.

The exemplary FRW may, for example, be used in a Paincake snatch in a rested position. The exemplary FRW may, for example, be used in a Paincake snatch in a raised position.

The exemplary FRW may, for example, be used in a Paincake snatch in a side rested position. The exemplary FRW may, for example, be used in a Paincake snatch in transitional position. The exemplary FRW may, for example, be used in a Paincake snatch in a raised position.

The exemplary FRW may, for example, be used in a one-arm push press in a rested position. The exemplary FRW may, for example, be used in a one-arm push press in a raised position.

The exemplary FRW may, for example, be used in a Russian twist, also referred to an American Hammer, in a right position. The exemplary FRW may, for example, be used in a Russian twist, also referred to an American Hammer, in a left position.

The exemplary FRW may, for example, be used in a front raise in a rested position. The exemplary FRW may, for example, be used in a front raise in a raised position.

The exemplary FRW may, for example, be used in a Paincake snatch in a squat position. The exemplary FRW may, for example, be used in a Paincake snatch in transitional position The exemplary FRW may, for example, be used in a Paincake snatch in a raised position.

The exemplary FRW may, for example, be used in a concentration curl in a rested position. The exemplary FRW may, for example, be used in a Paincake snatch in transitional position. The exemplary FRW may, for example, be used in a Paincake snatch in a flex position.

The exemplary FRW may, for example, be used in a two-arm tricep extension in a rest position from a front view. The exemplary FRW may, for example, be used in a two-arm tricep extension in a raised position from the front view.

The exemplary FRW may, for example, be used in a two-arm tricep extension in a rest position from a back view.

The exemplary FRW may, for example, be used in a two-arm tricep extension in a raised position from the back view.

The exemplary FRW may, for example, be used in a single-arm tricep extension in a rested position. The exemplary FRW may, for example, be used in a single-arm tricep extension in an extended position.

The exemplary FRW may, for example, be used in a forearm stabilizer extension in a rested position. The exemplary FRW may, for example, be used in a forearm stabilizer extension in an extended position.

The exemplary FRW may, for example, be used in a Paincake clean jerk in a squat position. The exemplary FRW may, for example, be used in a Paincake clean jerk in transitional position. The exemplary FRW may, for example, be used in a Paincake clean jerk in a raised position.

The exemplary FRW may, for example, be used in a rested position. The exemplary FRW may, for example, be used in a Paincake Raise, also know as a Texas Hold'em position. The exemplary FRW may, for example, be used in an overhead shoulder raise.

The exemplary FRW may, for example, be used in a one-arm slow-down in a start position. The exemplary FRW may, for example, be used in a one-arm slow-down in a lowered position. The exemplary FRW may, for example, be used in a one-arm slow-down in a raised position.

The exemplary FRW may, for example, be used in a single-leg Romanian deadlift in a starting position. The exemplary FRW may, for example, be used in a single-leg Romanian deadlift in an extended position.

The exemplary FRW may, for example, be used in a front squat in a squat position. The exemplary FRW may, for example, be used in a front squat in a standing position.

The exemplary FRW may, for example, be used in a Zercher squat in a squat position. The exemplary FRW may, for example, be used in a Zercher squat in a standing position.

The exemplary FRW may, for example, be used in a goblet squat in a squat position. The exemplary FRW may, for example, be used in a goblet squat in a standing position.

The exemplary FRW may, for example, be used in a Paincake chin pull in a starting position. The exemplary FRW may, for example, be used in a g Paincake chin pull in a raised position.

The exemplary FRW may, for example, be used in an elevated Paincake Row in a starting position. The exemplary FRW may, for example, be used in an elevated Paincake Row in a raised position.

The exemplary FRW may, for example, be used in an elevated, neutral grip pushup in a starting position. The exemplary FRW may, for example, be used in an elevated, neutral grip pushup in a raised position.

The exemplary FRW may, for example, being put in a rucksack. The exemplary FRW may, for example, be used in a rucksack.

The exemplary FRW may, for example, be used in a dual-handed concentration curl. The exemplary FRW may, for example, beused in a dual-handed concentration curl.

The exemplary FRW may, for example, be put in a ruck's pocket. The exemplary FRW may, for example, be used in a ruck's pocket.

The exemplary FRW may, for example, be used in a ruck. The exemplary FRW may, for example, be used in a ruck.

The exemplary FRW may, for example, be used in a ruck. The exemplary FRW may, for example, be used in a ruck. The exemplary FRW may, for example, be used in a ruck.

The exemplary FRW may, for example, be used in a kneeling pancake halo in a first position. The exemplary FRW may, for example, be in a kneeling pancake halo in a second position. The exemplary FRW may, for example, be used in a kneeling pancake halo in a third position. The exemplary FRW may, for example, be used in a kneeling pancake halo in a fourth position.

Figure 2:
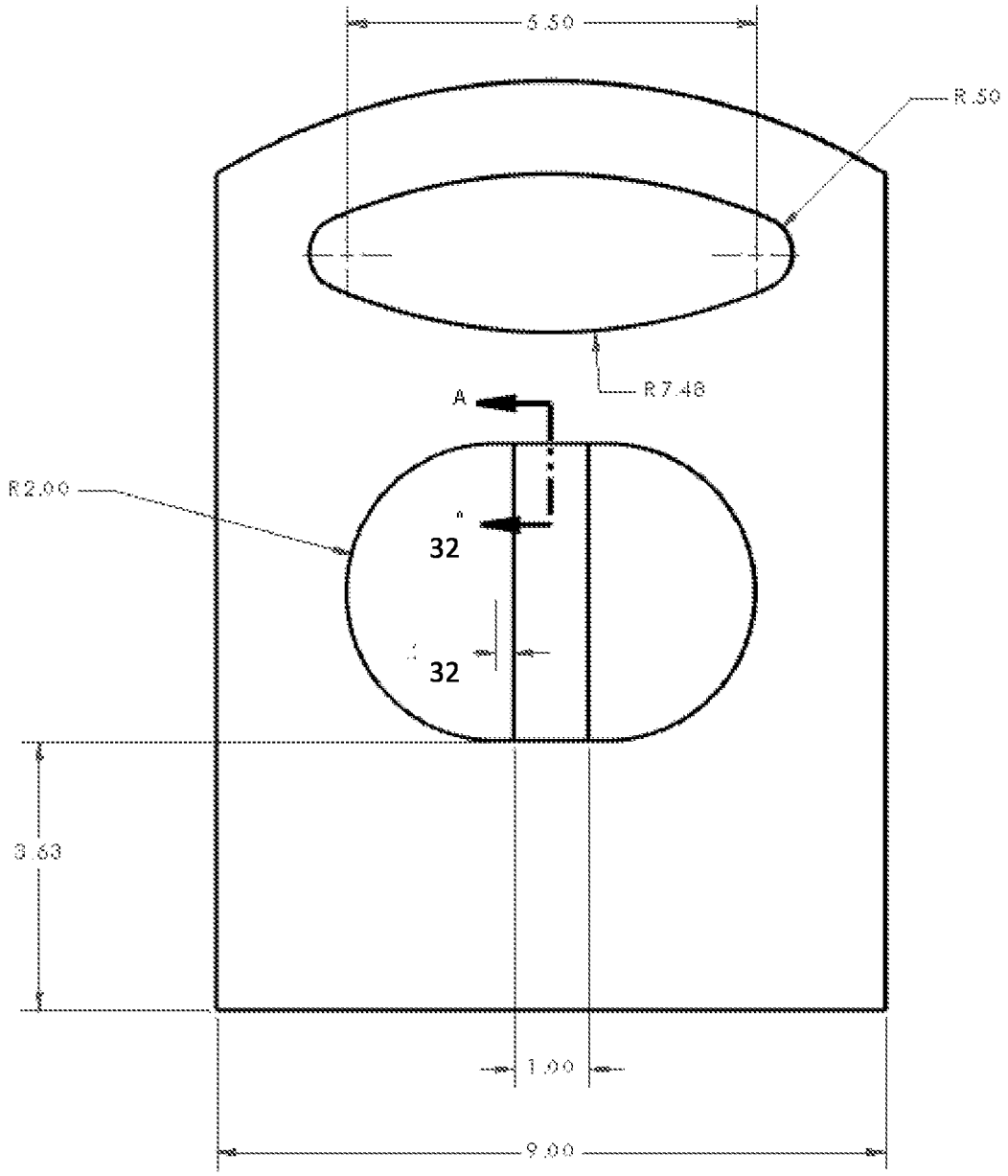
FIG. 2 depicts a front view of the structural dimensions of an exemplary FRW.
Figure 3:
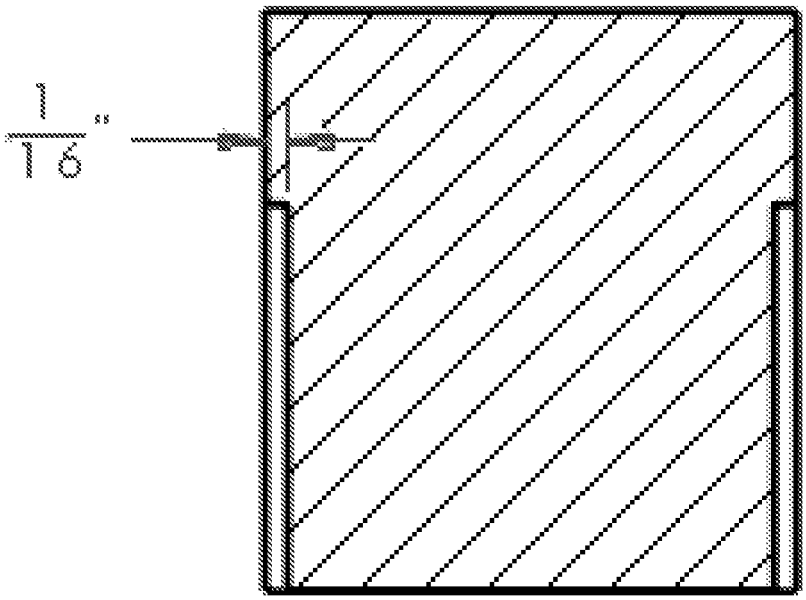
FIG. 3 depicts a cross-sectional view of the structural dimensions of an exemplary FRW.

FIG. 2 depicts a front view of the structural dimensions of an exemplary FRW. FIG. 3 depicts a cross-sectional view of the structural dimensions of an exemplary FRW.

Figure 4:
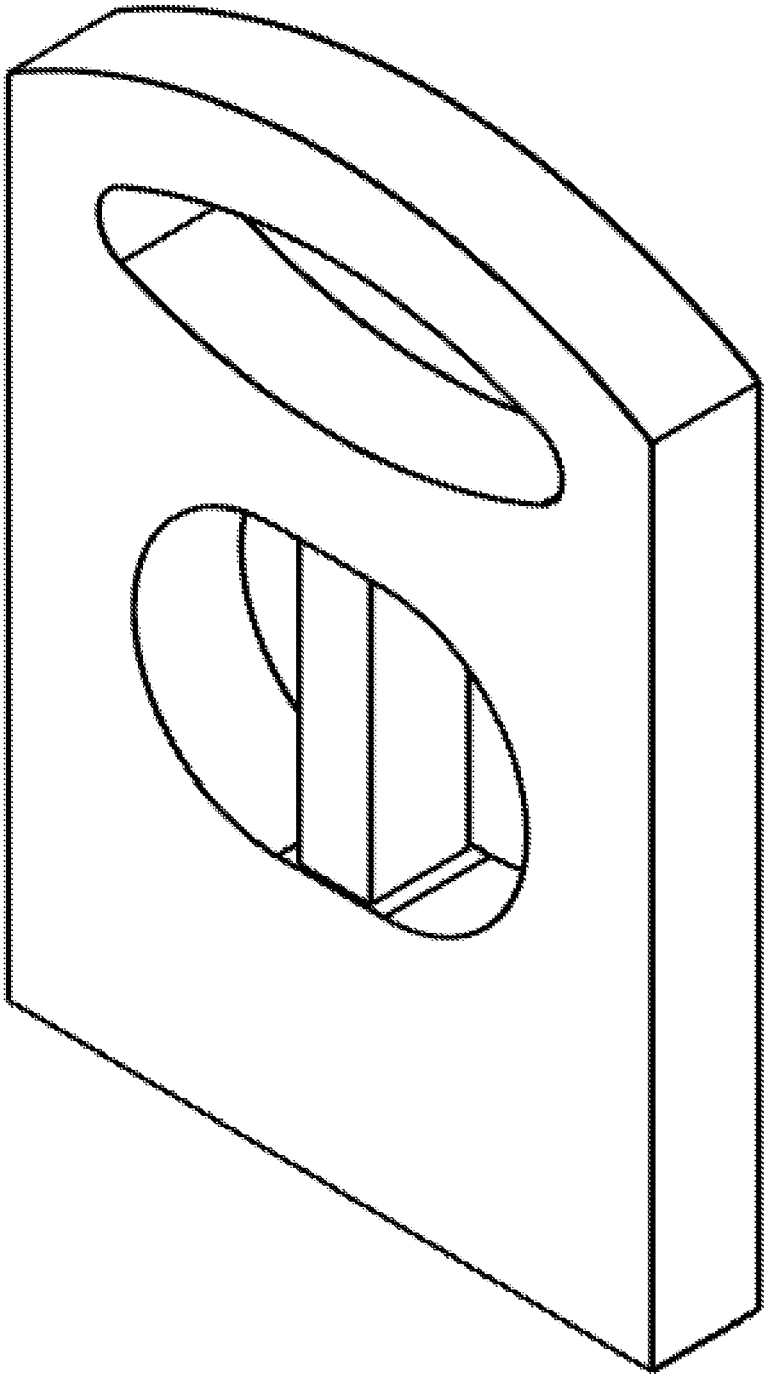
FIG. 4 depicts an exploded view of an exemplary FRW.
Figure 5:
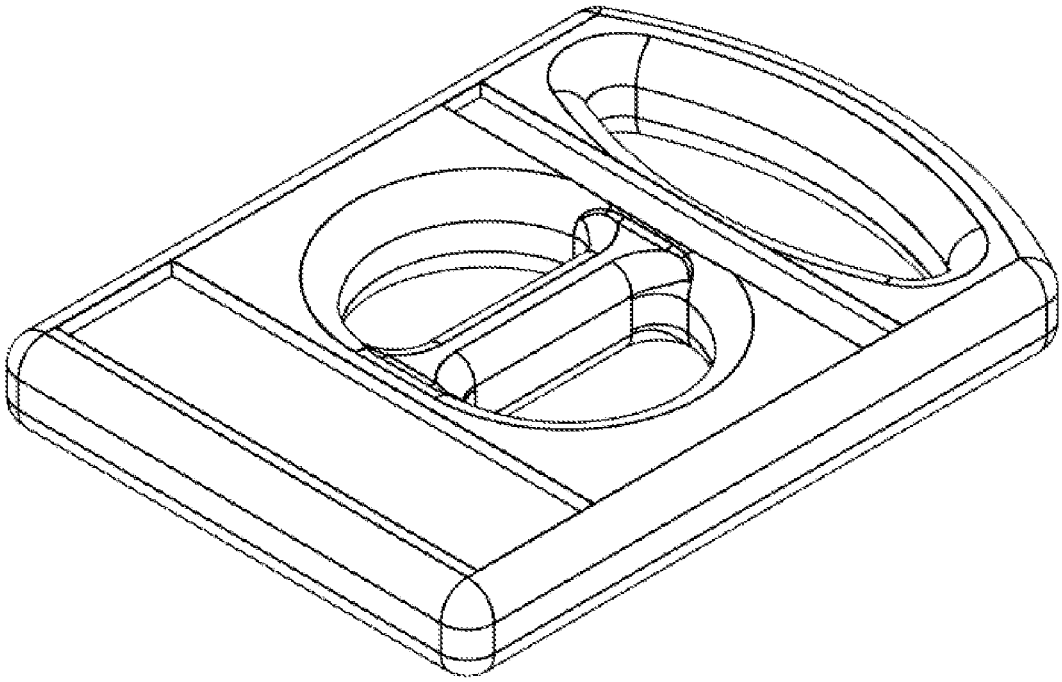
FIG. 5 depicts an exploded view of an exemplary FRW.
Figure 6:
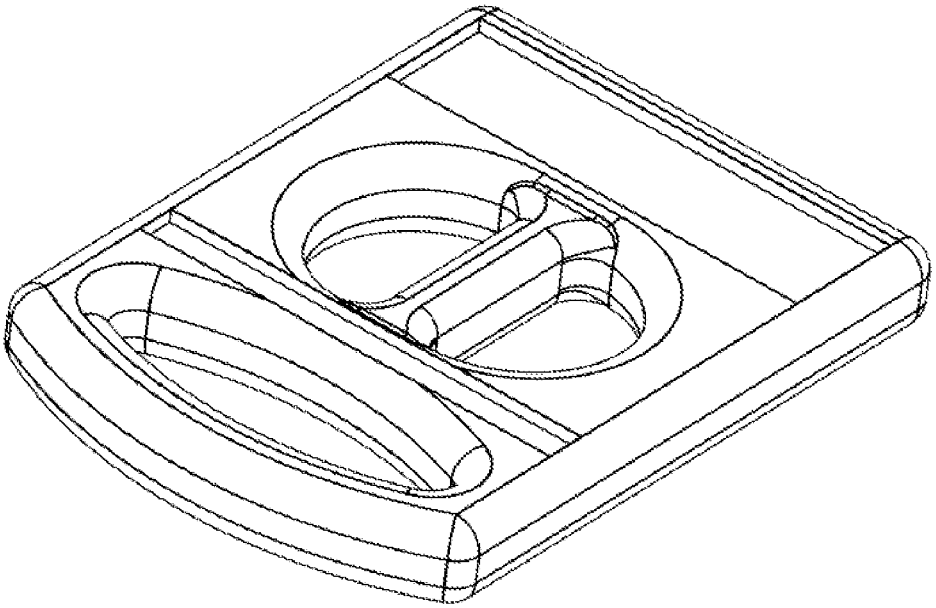
FIG. 6 depicts an exploded view of an exemplary FRW.
Figure 7:
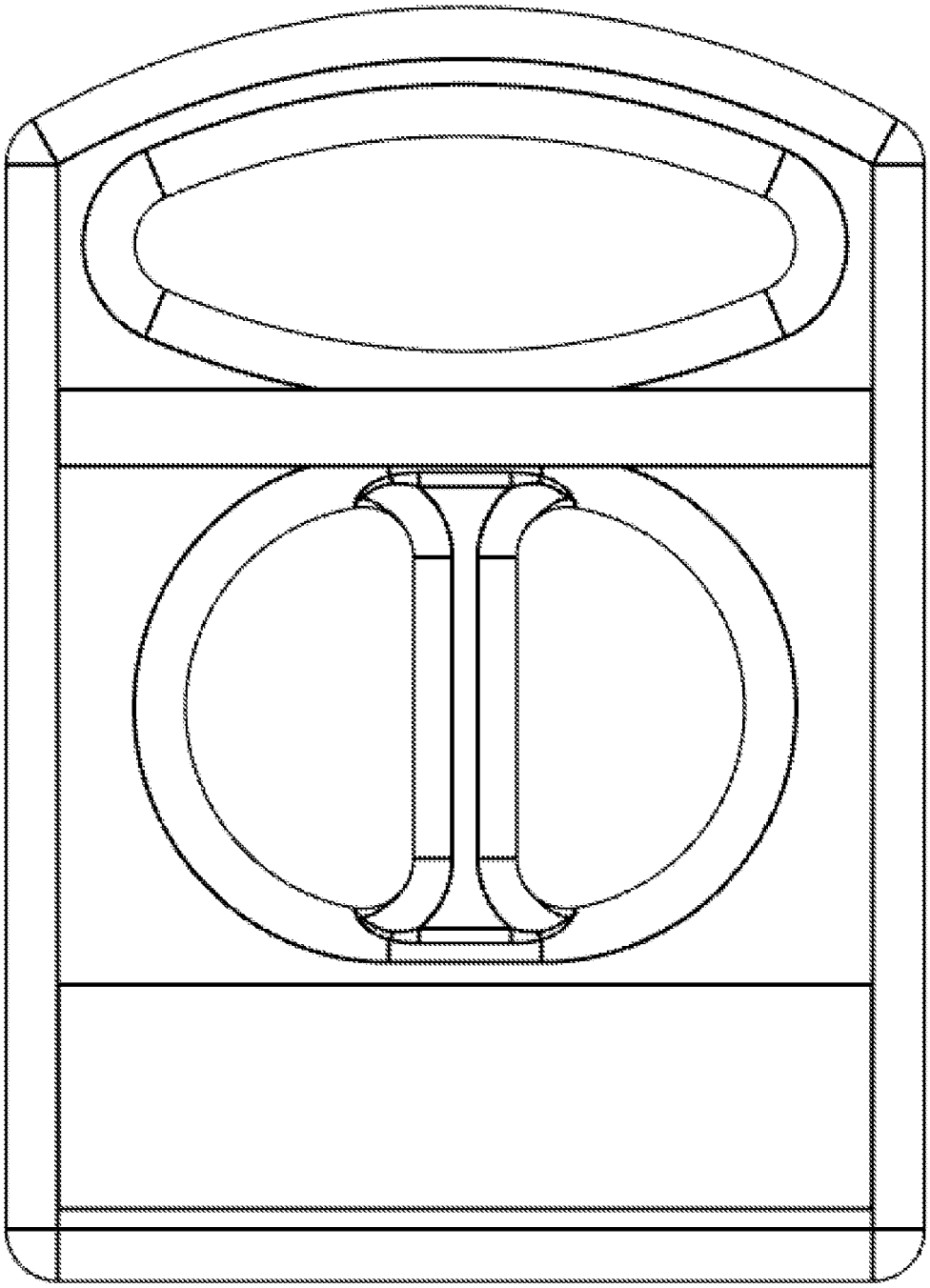
FIG. 7 depicts a front view of an exemplary FRW.
Figure 8:
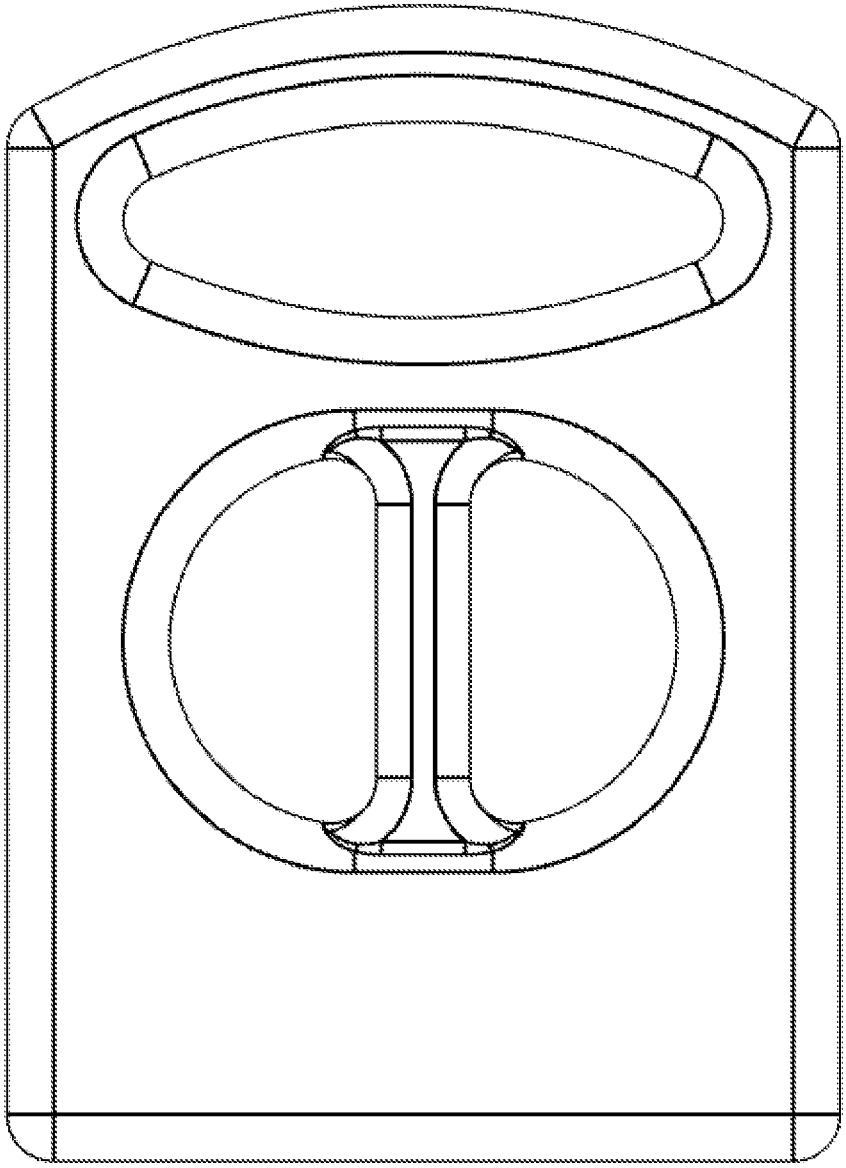
FIG. 8 depicts a back view of an exemplary FRW.
Figure 9A:
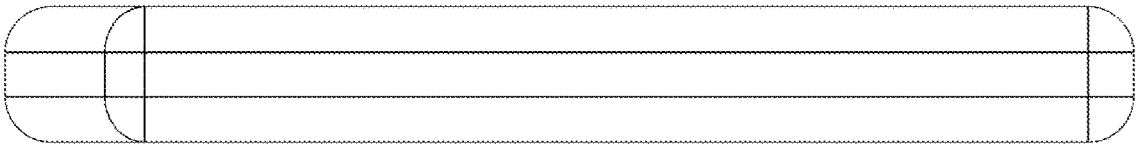
FIG. 9A depicts a left view of an exemplary FRW.
Figure 9B:
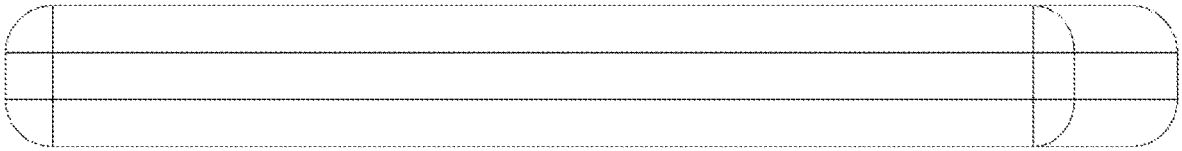
FIG. 9B depicts a reversed right view of an exemplary FRW.
Figure 10A:
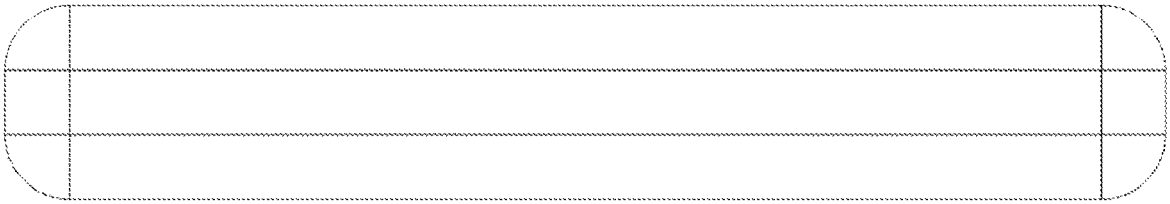
FIG. 10A depicts a top view of an exemplary FRW.
Figure 10B:
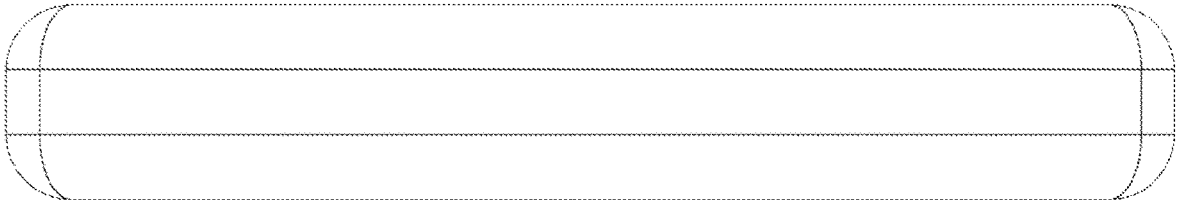
FIG. 10B depicts a bottom view of an exemplary FRW.

FIGS. 4-10B depict several views of an exemplary FRW. FIGS. 4-6 depict an exploded views of an exemplary FRW. FIG. 7 depicts a front view of an exemplary FRW. FIG. 8 depicts a back view of an exemplary FRW. FIG. 9A depicts a left view of an exemplary FRW. FIG. 9B depicts a reversed right view of an exemplary FRW. FIG. 10A depicts a top view of an exemplary FRW. FIG. 10B depicts a bottom view of an exemplary FRW.

Although various embodiments have been described with reference to the figures, other embodiments are possible. For example, the FRW may come in different sizes and/or weights. For example, the FRW may be substantially 20 lbs. In some embodiments the FRW may be substantially 40 lbs. In some embodiments the FRW may be substantially 60 lbs. In some embodiments the FRW may be more than 60 lbs. In some embodiments the FRW may be less than 20 lbs. In some implementations, two FRWs may be interconnected with a bar to be converted into a barbell. In some implementations, the FRW may be stackable. For example, two or more FRWs may be stacked to be used for sled pull and/or prowler push exercises.

Although an exemplary system has been described with reference to FIGS. 1-10B, other implementations may be deployed in other medical, military, commercial, and/or residential applications. Weights may, for example, be used by physical therapists to aid an athlete recover from an athletic injury. In circumstances, the FRW may, for example, be made of a light weight material and be used for an athlete to recover loss motion from injuries. The FRW may, for example, be used in the military for physical fitness tests. Some military branches have been moving away from standard pushups, situps, and timed running to incorporate weighted exercises. The FRW may, for example, be incorporated as a weighted exercise in a military standard fitness test.

The FRW may, for example, be used in commercial settings. A user may, for example, find transporting traditional dumbells over long distances or over plane difficult. However, the FRW allows for fast and compact travel as the FRW can be stored in a ruck, carryon bag, and or a backpack.

The FRW may, for example, be used in residential applications. The FRW may, for example, be used as a weighted set in a residential apartment gym complex. Group exercises with trained instructors may, for example, carryout exercises with the FRW. The instructors using the FRW may, for example, be recorded and be posted online as a video recording and/or audio recording directing exercises with the FRW. Workout calendars may, for example, may incorporate the FRW into a person's physical fitness routine and/or training regiment.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A weight comprising:

a body bounded by a top surface and a bottom surface, each having a major dimension and a minor dimension, and separated by a thickness of opposing side edge surfaces and proximal and distal end edge surfaces to define a spatial envelope of the body configured such that, in a packing mode, the body is carryable flat against a body of a user, wherein the thickness is less than the minor dimension and the body is reflectively mirrored about a bisecting longitudinal axis relative to the minor dimension of the top surface;

a first swing handle defined by the proximal end edge surface, the opposing side edge surfaces, and a first aperture extending through the body from the top surface to the bottom surface at a proximal end of the body, the first aperture having a major axis aligned with the minor axis of the top surface, the first aperture configured such that, in a two-handed swinging mode, a first hand and a second hand of the user are spatially distributed and oriented along intersecting axes; and, a grip handle distal to the swing handle, the grip handle defined by a second aperture and a third aperture each extending through the top surface and the bottom surface, the grip handle configured such that, in a dumbbell mode, the first hand of the user is inserted through the second aperture and the third aperture to grip the grip handle at a center gravity of the body, wherein a total width across the second aperture and the third aperture in the minor dimension of the top surface is less than a width of the first aperture in the minor dimension of the top surface;

wherein the top surface includes a recess parallel to the axis orthogonal to the longitudinal axis of the body, configured such that the recess is located near the proximal end of the body distal to the first aperture.

2. The weight of claim 1, further comprising: at least one recess configured to couple to one external attachment.

3. The weight of claim 2, wherein the attachment comprises a message.

4. The weight of claim 2, wherein the attachment comprises a phosphorescent material.

5. The weight of claim 1, further comprising a second swing handle:

wherein the second swing handle is defined by a fourth aperture extending through the top surface and the bottom surface at a distal end of the body, the fourth aperture configured such that, in the two-handed swinging mode, the first hand and the second hand of the user are spatially distributed and oriented along intersecting axes.

6. The weight of claim 1, further comprising a curved distal end of the body.

7. The weight of claim 1, wherein the grip handle is angled relative to the longitudinal axis of the body.

8. The weight of claim 1, wherein the grip handle is parallel to an axis orthogonal to the longitudinal axis of the body.

9. The weight of claim 1, wherein the top surface includes at least one finger divot distal to the first aperture and located near the proximal end of the body.

10. The weight of claim 1, wherein the bottom surface includes at least one finger divot distal to the first aperture and located near the proximal end of the body.

11. The weight of claim 1, wherein the bottom surface includes a recess parallel to an axis orthogonal to the longitudinal axis of the body, configured such that the recess is located near the proximal end of the-body distal to the first aperture.

12. The weight of claim 1, wherein the grip handle includes a grip attachment coupled to the grip handle and disposed to at least partially separate the user's hand from the grip handle.

13. The weight of claim 1, wherein the swing handle includes a grip attachment coupled to the swing handle and disposed to at least partially separate the user's hand from the swing handle.

14. The weight of claim 1, wherein the grip handle includes contours configured such that the contours improve the grip and helps prevent the user's hands from ripping.

15. The weight of claim 1, wherein the swing handle includes contours configured such that the contours increase a surface area of engagement with the user's hands.

16. The weight of claim 1, wherein the grip handle includes a textured grip configured such that the textured grip increases a coefficient of friction between the user's hands and the grip handle.

17. The weight of claim 1, wherein the grip handle comprises a coated grip.

18. The weight of claim 1, wherein the spatial envelope is coated by an external damper configured such that the external damper absorbs kinetic energy during an impact.

* * * * *